US005188929A

United States Patent [19]

Ishii

[11] Patent Number: 5,188,929

[45] Date of Patent: Feb. 23, 1993

[54] ELECTROSTATIC IMAGE DEVELOPING TONER COMPRISING COMPLEX COMPOUNDS CONTAINING SILICON

[75] Inventor: Yukihiro Ishii, Kanagawa, Japan

[73] Assignee: Fuji Xerox Co., Ltd., Tokyo, Japan

[21] Appl. No.: 673,375

[22] Filed: Mar. 22, 1991

[30] Foreign Application Priority Data

Mar. 27, 1990 [JP] Japan ..... 2-77718

[51] Int. Cl.[5] ..... G03G 9/097

[52] U.S. Cl. ..... 430/110; 430/109; 430/105

[58] Field of Search ..... 430/110, 115, 105, 109, 430/903, 901

[56] References Cited

U.S. PATENT DOCUMENTS

| | | | |
|---|---|---|---|
| 4,086,091 | 4/1978 | Cella | 96/36.2 |
| 4,767,688 | 8/1988 | Hashimoto et al. | 430/110 |
| 4,845,003 | 7/1989 | Kiriu et al. | 430/110 |
| 4,921,768 | 5/1990 | Kunugi et al. | 430/45 |

OTHER PUBLICATIONS

A. Bourdin et al. "Reactivity of Dianionic Hexacoordinated Silicon Complexes Toward Nucleophiles: A New Route to Organosilanes from Silica," Organometallices vol. 7, 1988, pp. 1165-1171.

"Pentacoordinate Silicon Derivatives II, Salts of Bis (o-arylenedioxy) organosiliconic Acids," Journal of American Chemical Society vol. 86, 1964, pp. 3170-3171.

*Primary Examiner*—Marion E. McCamish
*Assistant Examiner*—Rosemary Ashton
*Attorney, Agent, or Firm*—Finnegan, Henderson, Farabow, Garrett and Dunner

[57] ABSTRACT

A toner for developing an electrostatic image is disclosed, essentially comprising as a colorless charge electrification controlling agent causing no environmental pollution, a complex compound containing a silicon atom to which at least 2 mols of at least one of a chelating monocyclic or polycyclic aromatic diol, monocyclic or polycyclic aromatic hydroxycarboxylic acid, or monocyclic or polycyclic aromatic dicarboxylic acid is coordinated per mol of the silicon atom. The toner exhibits stable charging properties against environmental changes or on repeated use.

4 Claims, No Drawings

ELECTROSTATIC IMAGE DEVELOPING TONER COMPRISING COMPLEX COMPOUNDS CONTAINING SILICON

FIELD OF THE INVENTION

The present invention relates to a toner for developing an electrostatic image in electrophotography, electrostatic recording, and the like.

BACKGROUND OF THE INVENTION

Various charge control agents have hitherto been used for controlling a quantity of electrification of a toner. Known negative charge electrification controlling agents include colored compounds, such as chromium complex salts of azo dyes and chromium complex salts of aromatic hydroxycarboxylic acids, and colorless compounds, such as aluminum, zinc or boron complex salts of aromatic hydroxycarboxylic acids or aromatic dicarboxylic acids.

Although the colored charge electrification controlling agents possess appreciable effects to impart negative chargeability to toner particles, they could not be used for a color toner, particularly full color toners of three primary colors for providing a full color image or, if find any use, only provide an image of very poor color reproduction.

On the other hand, the colorless charge control agents do not have sufficient effects to impart negative chargeability to toner particles and, in particular, the resulting toners lack stability of chargeability against environmental changes especially when repeatedly used for a long period of time.

Moreover, since many metals inclusive of chromium and zinc are candidates for sources of heavy metal pollution, there is a social demand to avoid use of these metals from the standpoint of environmental conservation.

SUMMARY OF THE INVENTION

An object of the present invention is to provide a colorless charge electrification controlling agent for a color toner, particularly for full color toners employable in process color copying machines or printers.

Another object of the present invention is to provide a toner containing a charge electrification controlling agent, in which the toner has stable chargeability against environmental changes or long-term repeated use.

A further object of the present invention is to provide a toner containing a charge electrification controlling agent which does not become a source of heavy metal pollution.

The present invention relates to a toner for developing an electrostatic image essentially comprising a complex compound containing a silicon atom to which at least 2 mols of at least one of a chelating monocyclic or polycyclic aromatic diol, monocyclic or polycyclic aromatic hydroxycarboxylic acid, or monocyclic or polycyclic aromatic dicarboxylic acid is coordinated per mol of the silicon atom (hereinafter simply referred to as an Si-containing complex compound).

DETAILED DESCRIPTION OF THE INVENTION

In the Si-containing complex compound which can be used in the present invention, examples of the chelating monocyclic or polycyclic aromatic diol, monocyclic or polycyclic aromatic hydroxycarboxylic acid, or monocyclic or polycyclic aromatic dicarboxylic acid include compounds known to be capable of forming a chelate, including catechol (1,2-phenyldiol), 2,3-naphthalenediol, 2,2'-biphenyldiol, salicylic acid, 2-hydroxy-3-naphthoic acid, orthophthalic acid, and 2,3-naphthalenedicarboxylic acid, and derivatives of these compounds, such as alkylated compounds, alkenylated compounds, arylated compounds, and alkoxylated compounds. Among these, a polycyclic aromatic dicarboxylic acid is preferred.

The Si-containing complex compounds which can be used in the present invention preferably include those represented by formulae (I) to (IV):

(I)

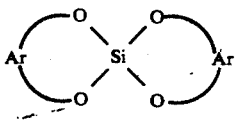

(II)

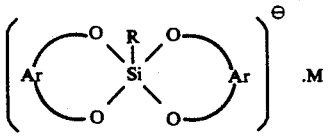

(III)

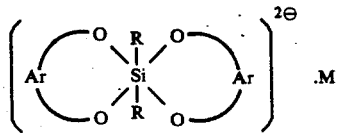

(IV)

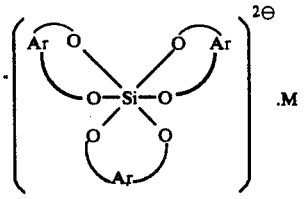

wherein Ar represents an alkyl-substituted or unsubstituted o-phenylene group, an alkyl-substituted or unsubstituted 2,3-naphthylene group, an alkyl-substituted or unsubstituted 2,2'-biphenylene group, or an alkyl-substituted or unsubstituted

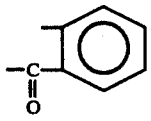

group (the substituted alkyl group has 6 carbon atoms or more); R represents an alkyl group, an alkoxy group, or an aryl group (R has the total carbon atoms of 4 or more); and M represents a monovalent or divalent cation.

Illustrative examples of these Si-containing complex compounds are shown below.

(A) Compounds of formula (I) (coordination number=4):

(A) Compounds of formula (I) (coordination number = 4):

(1) Bis(catecholato)silicone

-continued

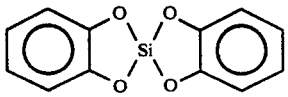

(2) Bis(salicylato)silicone

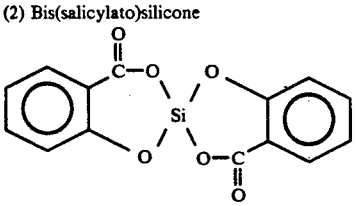

(B) Compounds of formula (II) (coordination number = 5):

(3) Bis(catecholato)phenylsilicon anion

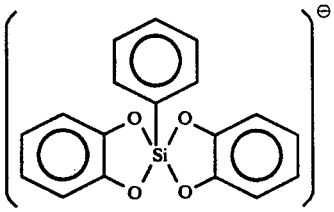

(4) Bis(3,5-di-t-butylcatecholato)phenylsilicon anion

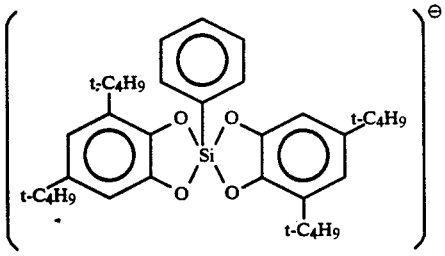

(5) Bis(salicylato)phenylsilicon anion

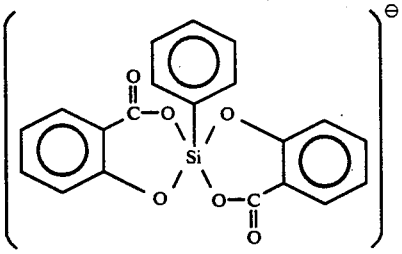

(6) Bis(salicylato)methylsilicon anion

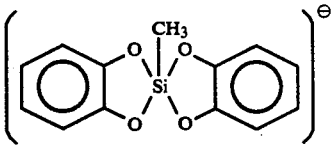

(7) Bis(2,8-naphthalenediolato)phenylsilicon anion

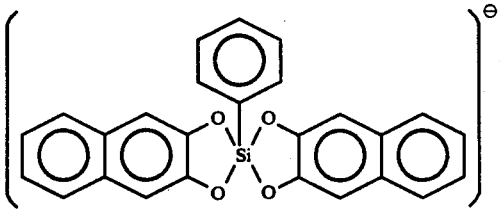

(8) Bis(1,10-biphenyldiolato)phenylsilicon anion

-continued

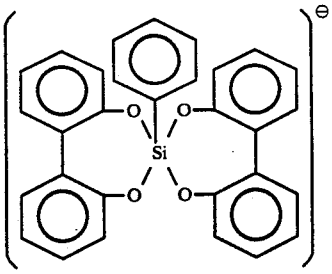

(C) Compounds of formulae (III) and (IV) (coordination number = 6):

(9) Tris(catecholato)silicon anion

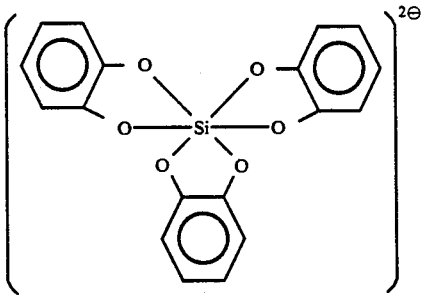

(10) Tris(salicylato)silicon dianion

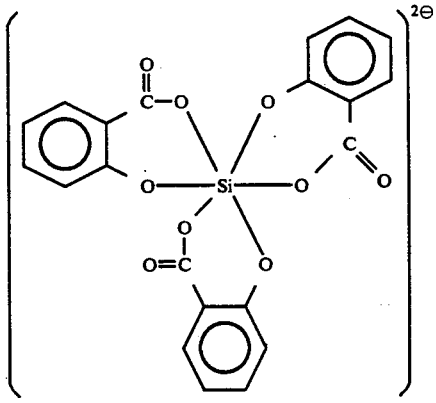

(11) Bis(1,10-bisphenyldiolato)bis(t-butoxy)silicon anion

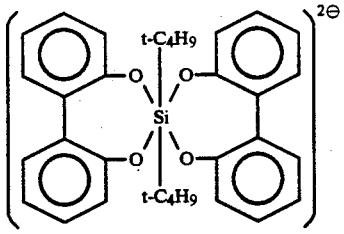

In the formulae shown above, the compounds of groups (B) and (C) are illustrated only by their anion. The counter ion may be a proton or a cation of an alkali metal, an alkaline earth metal, ammonium, or pyridinium or a derivative thereof. Among these, the preferred counter ion is a proton or a cation of an alkali metal.

The Si-containing complex compound is added as a charge electrification controlling agent to a known toner composition comprising a colorant and a binder resin. The amount to be added ranges from 0.01 to 10 parts by weight, and preferably from 0.1 to 5 parts by weight, per 100 parts by weight of the toner composition. Besides being dispersed or dissolved in the inside of toner particles, the Si-containing complex compound may be added selectively to the surface layer of toner particles or added to the outside of toner particles. Where the Si-containing complex compound is added to toner particles, it is mechanically mixed with a toner together with a binder resin by melting, emulsifying, dissolving, or the like means, or a binder resin may be prepared by polymerizing a monomer(s) in the presence of the Si-containing complex compound, and the Si-containing complex compound in the resulting binder resin may be mixed or melted with a toner. Preferably, the Si-containing complex compound is dispersed in the inside of toner particles.

Binder resins which can be used in the present invention are selected from known binder resins, for example, homo- or copolymers of vinyl monomers, such as styrene or derivatives thereof, e.g., styrene, vinyltoluene, methylstyrene, chlorostyrene, and aminostyrene, methacrylic acid or esters thereof, e.g., methyl methacrylate, ethyl methacrylate, and butyl methacrylate, acrylic acid or esters thereof, e.g., methyl acrylate, ethyl acrylate, butyl acrylate, and 2-ethylhexyl acrylate, diene compounds, e.g., butadiene and isoprene, acrylonitrile, vinyl ethers, maleic acid or esters thereof, maleic anhydride, vinyl chloride, and vinyl acetate; olefin polymers, e.g., polyethylene and polypropylene; natural and synthetic waxes; polyester resins, polyamide resins, epoxy resins, polycarbonate resins, polyurethane resins, silicone resins, fluorine-containing resins, petroleum resins, etc., either individually or in combination thereof.

Colorants which can be used in the toner of the present invention are selected from dyes and pigments well known in the field of printing ink or other coloring uses, such as black dyes or pigments, e.g., carbon black, Oil Black, and graphite; .acetoacetic acid arylamide type monoazo yellow pigments (Fast Yellow series), e.g., C.I. Pigment Yellows 1, 3, 74, 97 and 98; acetoacetic acid arylamide type dis-azo yellow pigments, e.g., C.I. Pigment Yellows 12, 13 and 14; yellow dyes, e.g., C.I. Solvent Yellows 19, 77 and 79, and C.I. Disperse Yellow 164; red or scarlet pigments, e.g., C.I. Pigment Reds 48, 49:1, 53:1, 57:1, 81, 122 and 5; red dyes, e.g., C.I. Solvent Reds 52, 58 and 8; blue dyes or pigments, e.g., copper phthalocyanine and derivatives or modified compounds thereof; green pigments, e.g., C.I. Pigment Greens 7 and 36 (Phthalocyanine Green); and colored or colorless sublimating dyes.

These colorants may be used either individually or in combination of two or more thereof. If desired, they may be mixed with extender pigments or white pigments to control the color tone. In order to improve dispersibility in binder resins, the surface of the colorant may be treated with a surface active agent, a coupling agent (e.g., silane coupling agent), or a high polymeric material. For the same purpose, high polymer dyes or high-molecular weight graft pigments may be used.

A concentration of colorants in a toner is not critically specified because it is dependent on the specific gravity of toner constituting materials, e.g., a binder resin and the colorant; the coloring power of the colorant; and the particle size distribution of toner particles and is also influenced by the amount of a toner to be used for development and the thickness of a toner particle layer. Where the toner particles have an average diameter $d_{50}$ of, for example, about 10 μm, with the toner particle layer being controlled to have a single layer structure or an about two layer structure, a suitable content of the colorant is from about 2 to about 10% by weight. As a matter of course, the colorant content would be reduced where the toner particles have a greater size, or it would be increased where the particle size is smaller.

The toner containing the Si-containing complex compound according to the present invention exhibits sufficient negative chargeability (i.e., negative electrification property) by itself. If desired, the toner may further contain a magnetic substance, e.g., a ferrite powder, a conductivity controlling agent, an inorganic substance such as metallic oxides, e.g., tin oxide, silica, alumina, titanium oxide, and zinc oxide, an extender pigment, a reinforcing filler, e.g., a fibrous material, an antioxidant, a releasing agent, and so on.

In addition, various known external additives may be adhered or fixed to the surface of toner particles for the purposes of improving fluidity or chargeability (i.e., electrification property), preventing toner particles from filming on the surface of a photoreceptor or carrier particles, or improving cleaning properties of toner particles remaining on a photoreceptor. Such external additives include higher fatty acids, e.g., stearic acid, or derivatives thereof, e.g., metallic salts, esters and amides; inorganic powders, e.g., carbon black, tin oxide, fluorinated graphite, silicon carbide, boron nitride, silica, alumina, titanium dioxide, and zinc oxide; resin powders, e.g., fluorine-containing resins, acrylic resins, and silicone resins; polycyclic aromatic compounds; waxy substances; and the like.

The toner of the present invention can be prepared by any of known techniques, such as kneading and grinding, spray drying, direct polymerization, and the like. The toner particles preferably have an average diameter $d_{50}$ of from 1 to 20 μm, and more preferably from 5 to 15 μm, as measured with a Coulter Counter Method.

Usage of the toner in visualizing an electrical latent image or other electrical signals is not particularly limited, and any of known development techniques can be adopted. The toner can be used not only in general two-component development system and microtoning system but in a single-component development system using no charge carrier.

The present invention is now illustrated in greater detail with reference to Examples, but it should be understood that the present invention is not deemed to be limited thereto. All the percents, parts, and ratios are by weight unless otherwise indicated.

SYNTHESIS EXAMPLE 1

Synthesis of Compound (3) (Bis(catecholato)phenylsilicon Sodium Salt)

A solution of 0.0475 mol of trimethoxyphenylsilane in 10 ml of methanol and a solution of 0.0475 mol of sodium methoxide in 20 ml of methanol were mixed with stirring at room temperature in a nitrogen atmosphere. A solution of 10.34 g of catechol in 20 m; of methanol was added dropwise thereto at 25° C., and the mixture was kept at 45° C. for 4 hours in the same atmosphere. The reaction mixture was freed of methanol in a vacuum drier, washed twice with diethyl ether, and allowed to stand under vacuum at 100° C. for 1 day to obtain 13.2 g of the titled compound having a melting point of 220 to 230° C.

SYNTHESIS EXAMPLE 2

Synthesis of Compound (7)
(Bis(2,8-naphthalenediolato)phenylsilicon Pyridinium Salt)

A reflux condenser was fixed to a container containing a solution of 0.1 mol of 2,3-naphthalenediol in 3 ml of pyridine. The solution was kept at 90° C. under nitrogen pressure, and 0.05 mol of phenyltrimethoxysilane was added thereto. The mixture was kept at the same temperature for an additional period of 10 minutes, followed by gradually cooling to room temperature. The reaction mixture was worked-up in the same manner as in Synthesis Example 1 to obtain 19.5 g of the titled compound having a melting point of 247° C.

EXAMPLE 1

Ninety-five parts of a styrene-acrylate resin "SBM-73" (manufactured by Sanyo Chemical Industries Co., Ltd.), 2 parts of Compound (3) prepared in Synthesis Example 1, and 3 parts of Brilliant Carmine 6B were blended, ground, and classified in a usual manner to prepare a magenta toner having an average particle size of 12 μm.

The resulting magenta toner was mixed with a carrier comprising ferrite particles (diameter: 100 μm) uniformly coated with 1% of polymethyl methacrylate at a ratio of 3:100 to prepare a magenta developer.

The resulting developer was filled in a dry process color copying machine "FX-6800" (manufactured by Fuji Xerox Co., Ltd.) to carry out copying. As a result, clear magenta color images free from broken images, disturbances of image or fog could be obtained.

Further, the copying operation was repeated to obtain 100,000 copies at a low-temperature and low-humidity condition (10° C. and 15% RH, hereinafter the same) and at a high-temperature and high-humidity condition (28° C. and 85% RH, hereinafter the same). The resulting copies were quite equal to those obtained in the initial stage of running in image quality and color reproducibility. Thus, the toner proved extremely excellent as a full color toner.

EXAMPLE 2

A mixture of 95 parts of SBM-73, 2 parts of Compound (7) obtained in Synthesis Example 2, and 3 parts of a copper phthalocyanine pigment was treated in the same manner as in Example 1 to prepare a cyan toner having an average particle size of 12 μm. A cyan developer was prepared using the resulting toner in the same manner as in Example 1.

The resulting developer was filled in a color copying machine "FX-6800" to carry out copying. As a result, clear cyan color images free from broken images, disturbances of image or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

EXAMPLE 3

A mixture of 95 parts of SBM-73, 2 parts of Compound (10), and 3 parts of a bis-azo yellow pigment was treated in the same manner as in Example 1 to prepare a yellow toner having an average particle size of 12 μm. A yellow developer was prepared using the resulting toner in the same manner as in Example 1.

Copying test was carried out using the resulting developer in the same manner as in Example 1. As a result, clear yellow color images free from broken images, disturbances of images or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

Furthermore, the color toners prepared in Examples 1, 2, and 3 were simultaneously filled in the copying machine "FX6800" to carry out full color copying. As a result, color copies of clear image with broad range of color reproduction were obtained.

EXAMPLE 4

A mixture of 95 parts of SBM-73, 2 parts of Compound (10), and 3 parts of a quinacridone magenta pigment was treated in the same manner as in Example 1 to prepare a magenta toner having an average particle size of 12 μm. A magenta developer was prepared using the resulting toner in the same manner as in Example 1.

Copying test was carried out using the resulting developer in the same manner as in Example 1. As a result, clear magenta color images free from broken images, disturbances of image or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

EXAMPLE 5

A mixture of 95 parts of SBM-73, 2 parts of Compound (9), and 3 parts of a phthalocyanine pigment was treated in the same manner as in Example 1 to prepare a cyan toner having an average particle size of 12 μm. A cyan developer was prepared using the resulting toner in the same manner as in Example 1.

Copying test was carried out using the resulting developer in the same manner as in Example 1. As a result, clear cyan color images free from broken images, disturbances of image or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

EXAMPLE 6

A mixture of 95 parts of SBM-73, 2 parts of Compound (10), and 3 parts of Fast Yellow FGL pigment was treated in the same manner as in Example 1 to prepare a yellow toner having an average particle size of 12 μm. A yellow developer was prepared using the resulting toner in the same manner as in Example 1.

Copying test was carried out using the resulting developer in the same manner as in Example 1. As a result, clear yellow color images free from broken images, disturbances of image or fog could be obtained.

EXAMPLE 7

A mixture of 95 parts of a low-molecular weight polyester resin "SPAR II K" (manufactured by Kao K.K.), 2 parts of Compound (10), and 3 parts of Rhodamine B Lake was treated in the same manner as in Example 1 to prepare a magenta toner having an average particle size of 12 μm. A magenta developer was prepared using the resulting toner in the same manner as in Example 1.

Copying test was carried out using the resulting developer in the same manner as in Example 1. As a result, clear magenta color images free from broken images, disturbances of image or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

EXAMPLE 8

A mixture of 95 parts of SPAR II K, 2 parts of Compound (5), and 3 parts of a copper phthalocyanine pigment was treated in the same manner as in Example 1 to prepare a cyan toner having an average particle size of 12 μm. A cyan developer was prepared using the resulting toner in the same manner as in Example 1.

Copying test was carried out using the resulting developer in the same manner as in Example 1. As a result, clear cyan color images free from broken images, disturbances of image or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

EXAMPLE 9

A mixture of 95 parts of SPAR II K, 2 parts of Compound (3), and 3 parts of a dis-azo yellow pigment was treated in the same manner as in Example 1 to prepare a yellow toner having an average particle size of 12 μm. A yellow developer was prepared using the resulting toner in the same manner as in Example 1.

Copying test was carried out using the resulting developer in the same manner as in Example 1. As a result, clear yellow color images free from broken images, disturbances of image or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

Furthermore, the color toners prepared in Examples 7, 8, and 9 were simultaneously filled in the copying machine "FX6800" to carry out full color copying. As a result, color copies of clear image with broad range of color reproduction were obtained.

EXAMPLE 10

A mixture of 95 parts of SPAR II K, 2 parts of Compound (3), and 3 parts of carbon black was treated in the same manner as in Example 1 to prepare a black toner having an average particle size of 12 μm. A black developer was prepared using the resulting toner in the same manner as in Example 1.

Copying test was carried out using the resulting developer in the same manner as in Example 1. As a result, clear black color images free from broken images, disturbances of image or fog could be obtained.

Further, the copying operation was repeated to obtain 100,000 copies at a low-temperature and low-humidity condition and at a high-temperature and high-humidity condition. The resulting copies were quite equal to those obtained in the initial stage of running in image quality and color reproducibility. Thus, the toner proved extremely excellent as a full color toner.

Furthermore, the color toners prepared in Examples 7, 8, 9, and 10 were simultaneously filled in the copying machine "FX6800" to carry out full color copying. As a result, color copies of clear image with broad range of color reproduction were obtained.

COMPARATIVE EXAMPLE 1

A magenta toner was prepared in the same manner as in Example 1, except that Compound (3) was not used. Copying test was carried out using the resulting toner in the same manner as in Example 1. Copies obtained suffered from broken images, disturbances of image and fog. Moreover, fall-off of toner particles was observed from the initial stage of copying operation, proving the toner unacceptable.

COMPARATIVE EXAMPLE 2

A black toner was prepared in the same manner as in Example 1, except that Compound (3) was replaced with a chromium complex compound of a monoazo dye (a charge control agent sold by Hodogaya Chemical Co., Ltd. under the trade name of "Spiron Black TRH"). Copying test was carried out using the resulting toner in the same manner as in Example 1. Copies obtained were free from broken images, disturbances of image and fog but extremely poor in color reproduction, thus proving the full color toner unacceptable.

COMPARATIVE EXAMPLE 3

A magenta toner was prepared in the same manner as in Example 7, except that Compound (10) was not used. Copying test was carried out using the resulting toner in the same manner as in Example 1. Copies obtained had very poor image quality, suffering from broken images, disturbances of image and fog, proving the full color toner unacceptable.

COMPARATIVE EXAMPLE 4

A magenta toner was prepared in the same manner as in Example 7, except that Compound (10) was replaced with an aluminum complex compound of salicylic acid (a charge electrification controlling agent sold by Orient Kagaku Kogyo K.K. under the trade name of "Bontron E-88"). Copying test was carried out using the resulting toner in the same manner as in Example 1. Copies obtained showed a great improvement in color reproducibility but still had very poor image quality, suffering from broken images, disturbances of image and fog, proving the toner unacceptable for full color development.

As is described and demonstrated above, the Si-containing complex compound according to the present invention, which is a colorless negative charge electrification controlling agent, has excellent negative charge imparting properties (i.e., excellent negative electrification properties) and provides a toner having stable charging properties against environmental changes or on repeated use as well as excellent color reproducibility. The toner containing the Si-containing complex compound is therefore suitable for use in full color development.

While the invention has been described in detail and with reference to specific examples thereof, it will be apparent to one skilled in the art that various changes and modifications can be made therein without departing from the spirit and scope thereof.

What is claimed is:

1. A toner composition for developing an electrostatic image comprising:

a binder resin;

a colorant dispersed in the binder resin, and a complex compound containing a silicon atom to which at least two mols of at least one of a non-azo chelating monocyclic or polycyclic aromatic diol, monocyclic or polycyclic aromatic hydroxycarboxylic acid or monocyclic or polycyclic aromatic dicarboxylic acid is coordinated per mol of the silicon atom.

2. A toner composition according to claim 1, wherein said complex compound is represented by formulae (I) to (IV):

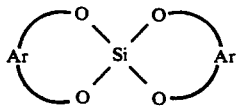

(I)

-continued

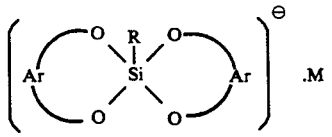

(II)

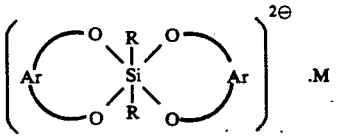

(III)

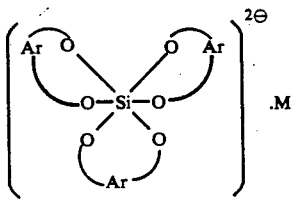

(IV)

wherein Ar represents an alkyl-substituted or unsubstituted o-phenylene group, an alkyl-substituted or unsubstituted 2,3-naphthylene group, an alkyl-substituted or unsubstituted 2,2'-biphenylene group, or an alkyl-substituted or unsubstituted

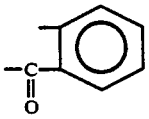

group; R represents an alkyl group, an alkoxy group, or an aryl group; and M represents a monovalent or divalent cation.

3. A toner composition as claimed in claim 1, wherein said complex compound containing a silicon atom is added in an amount of from 0.01 to 10 parts by weight per 100 parts by weight of the toner composition.

4. A toner composition as claimed in claim 1, wherein said complex compound containing a silicon atom is a polycyclic aromatic dicarboxylic acid.

* * * * *

UNITED STATES PATENT AND TRADEMARK OFFICE

CERTIFICATE OF CORRECTION

PATENT NO. : 5,188,929

DATED : February 23, 1993

INVENTOR(S) : Yukihiro Ishii

It is certified that error appears in the above-identified patent and that said Letters Patent is hereby corrected as shown below:

Claim 1, column 11, line 33, before "or" (first occurence) insert --,--.

Claim 2, column 11, line 36, change "according to" to --as claimed in--.

Signed and Sealed this

Fourth Day of January, 1994

*Attest:*

*Attesting Officer*

BRUCE LEHMAN

*Commissioner of Patents and Trademarks*